US006356017B1

(12) United States Patent
Makino

(10) Patent No.: US 6,356,017 B1
(45) Date of Patent: Mar. 12, 2002

(54) METHOD OF DRIVING A PLASMA DISPLAY PANEL WITH IMPROVED LUMINESCENCE EFFICIENCY

(75) Inventor: Mitsuyoshi Makino, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/228,239

(22) Filed: Jan. 11, 1999

(30) Foreign Application Priority Data

Sep. 1, 1998 (JP) ..... 10-002855

(51) Int. Cl.[7] ..... H01J 17/49; G09G 3/28

(52) U.S. Cl. ..... 313/583; 315/167.3; 315/169.4; 345/60

(58) Field of Search ..... 345/60, 63, 67, 345/68, 208; 313/582, 583; 315/169.3, 169.4, 169.2, 169.1

(56) References Cited

U.S. PATENT DOCUMENTS 4,665,345 A * 5/1987 Shionoya et al. ..... 315/169.4
6,011,355 A * 1/2000 Nagai ..... 345/60

FOREIGN PATENT DOCUMENTS

| | | |
|---|---|---|
| JP | S47-24763 | 10/1972 |
| JP | 47-24763 | 10/1972 |
| JP | 48-14144 | 5/1973 |
| JP | 50-22607 | 7/1975 |
| JP | 56-18652 | 2/1981 |
| JP | 63-29797 | 2/1988 |
| JP | 2-220330 | 9/1990 |
| JP | 02-297836 | 12/1990 |
| JP | 04-181633 | 6/1992 |
| JP | 07-162052 | 6/1995 |
| JP | 7-219474 | 8/1995 |
| JP | 8-305321 | 11/1996 |
| JP | H9-68944 | 3/1997 |

* cited by examiner

*Primary Examiner*—Don Wong
*Assistant Examiner*—Joseph Williams
(74) *Attorney, Agent, or Firm*—Sughrue Mion, PLLC

(57) ABSTRACT

A plasma display panel includes display cells disposed in matrix at cross points of a plurality of common electrodes and a plurality of data electrodes. In each of the display cells, data writing discharge and sustaining discharge are performed to emit light. Brightness is controlled by applying a sustaining pulse having a frequency higher than $\mu_i V/(\pi d^2)$ between the sustaining electrodes, where $\mu_i$ is an ion mobility of the discharge gas filled in the display cell, V is a maximum value of the applied voltage, and d is a distance between the sustaining electrodes performing the sustaining discharge.

6 Claims, 8 Drawing Sheets

METHOD OF DRIVING A PLASMA DISPLAY PANEL WITH IMPROVED LUMINESCENCE EFFICIENCY

BACKGROUND OF THE INVENTION (a) Field of the Invention

The present invention relates to a plasma display panel and a method for driving the same. More specifically, the present invention relates to a technique for driving an AC discharge plasma display panel.

(b) Description of the Related Art

Generally speaking, a plasma display panel (hereinafter called as "PDP") has several advantages such as thin configuration, little flicker, large contrast, relatively large display area, high display speed and the like. Thus, plasma display panels will be increasingly used for personal computers, workstations, flat television sets and other applications hereinafter.

There are two different types of PDP with respect to a driving scheme thereof. One is a DC discharge type PDP in which electrode conductors are exposed to the plasma ions, and the other is an AC discharge type PDP in which electrode conductors are covered with a dielectric film for insulation from the plasma ions. The AC discharge type PDP includes a memory PDP in which the display cell itself has a memory function using a charge accumulation effect of the dielectric while discharging through the dielectric, and a refreshing PDP that does not utilize the above memory function. Brightness or intensity of the PDP is generally proportional to the number of discharge times, i.e., the number of repetitive frequency of the drive pulses.

FIG. 1 is a cross section showing a typical AC discharge type color PDP. The PDP includes front and rear glass substrates (panels) 10 and 11. Scanning electrodes 12 and common electrodes 13 are formed on the front substrate 10. An insulator layer 15*a* is formed covering the scanning electrodes 12 and the common electrodes 13 on the front substrate 10. On the insulator layer 15*a*, a protective layer 16 made of MgO etc. is formed so as to protect the insulator layer 15*a* from the plasma discharge. On the other hand, data electrodes 19 are formed on the rear substrate 11. Covering the data electrodes 19, an insulator layer 15*b* is formed on the rear substrate 11. On the insulator layer 15*b*, a fluorescent film 18 is formed by coating to convert the ultraviolet ray generated by the plasma discharge into visual light.

A discharge space 20 is formed between the front substrate 10 and the rear substrate 11, and discharge gas including a mixture of He, Ne, Ar, Kr, Xe, $N_2$, $O_2$, $CO_2$ and other gases is filled in the discharge space 20. The discharge space 20 is secured by provision of a lattice partition 17, which separates the front substrate 10 from the rear substrate 11, and divides the discharge space 20 into a plurality of display cells arranged in a matrix. The fluorescent film 18 is colored in red, green or blue in each display cell, so as to display a multicolor image.

FIG. 2 is a schematic block diagram of the PDP shown in FIG. 1 for showing the electrode arrangement of the PDP. The electrode arrangement includes pairs of scanning electrode $\mathbf{12}_1$–$\mathbf{12}_m$ and common electrode $\mathbf{13}_1$–$\mathbf{13}_m$, as well as data electrodes $\mathbf{19}_1$–$\mathbf{19}_n$. Scanning electrodes $\mathbf{12}_1$–$\mathbf{12}_m$ and common electrodes $\mathbf{13}_1$–$\mathbf{13}_m$ constitute row electrodes, which are disposed in parallel to one another in the row direction on the front substrate 10. Data electrodes $\mathbf{19}_1$–$\mathbf{19}_n$ constitute column electrodes, which are disposed in the column direction on the rear substrate 11. Display cells 40 are disposed at respective cross points of the row electrodes and the column electrodes. In FIG. 2, display cells 40 are indicated by blocks arranged in a matrix with m x n elements.

A conventional method for driving the PDP of FIGS. 1 will be described with reference to a timing chart of FIG. 3 showing pulse waveforms applied to the electrodes of the PDP. A single driving period of the PDP includes a preliminary discharge period, a writing discharge period and a sustaining discharge period, which are iterated in this order so as to display a desired image.

In the preliminary discharge period, an erasing pulse 21 is applied to all the scanning electrodes $\mathbf{12}_1$–$\mathbf{12}_m$ simultaneously, to stop the sustaining discharge, thereby allowing all the display cells 40 to enter an erased state. Thereafter, a preliminary discharging pulse 22 is applied to all the common electrodes $\mathbf{13}_1$–$\mathbf{13}_m$ to force all the display cells to emit light by forced preliminary discharge for facilitating the subsequent writing discharge. Subsequently, a preliminary discharge erasing pulse 23 is applied to the scanning electrodes $\mathbf{12}_1$–$\mathbf{12}_m$ for erasing the preliminary discharge of all the display cells. In this description, "erase or erasing" means an operation of decreasing or deleting wall charge accumulated on the insulator.

In the writing discharge period, a scanning pulse 24 is applied to a corresponding one of the scanning electrodes $\mathbf{12}_1$–$\mathbf{12}_m$, with a certain timing period disposed between each two of the adjacent scanning pulses. In synchrony with the timing of the scanning pulses 24, data pulses 27 corresponding to display data are applied to the selected data electrodes $\mathbf{19}_1$–$\mathbf{19}_n$. Specifically, the data pulses 27 are applied to data electrodes corresponding to the selected display cells, and not applied to data electrodes corresponding to the unselected display cells. In FIG. 3, diagonal line in each rectangular data pulse 27 indicates that presence or absence of the data pulse 27 depends on the data to be written.

In the following selected display cell, to which the data pulse 27 was applied at the timing of the scanning pulse 24, generates writing discharge in the discharge space 20 between the scanning electrode 12 and the data electrode 19. In the selected display cell that generated the writing discharge, positive wall charge is accumulated on the insulator layer 15*a* adjacent the scanning electrodes 12. At the same time, negative wall charge is also accumulated on the insulator layer 15*b* adjacent the data electrodes 19.

In the sustaining discharge period, sustaining pulses 25 and 26 are applied to the common electrodes $\mathbf{13}_1$–$\mathbf{13}_m$ and the scanning electrodes $\mathbf{12}_1$–$\mathbf{12}_m$ so as to perform the sustaining discharge for maintaining a desired intensity in the display cells that performed the writing discharge in the writing discharge period. Specifically, a first sustaining discharge is generated by the potential difference between the positive potential generated by the positive wall charge accumulated on the insulator layer 15*a* and the negative potential of the first negative sustaining pulses 25 applied to the common electrodes 13. After the first sustaining discharge is generated, the positive wall charge is accumulated on the insulator layer 15*a* at portions adjacent the common electrodes 13, and the negative wall charge is accumulated on the insulator layer 15*a* at portions adjacent the scanning electrodes 12. Subsequently, the second sustaining pulses 26 is applied to the scanning electrodes 12 to be superimposed on the potential difference generated by the positive wall charge and the negative wall charge, resulting in generation of a second sustaining discharge.

In the subsequent intervals in the sustaining discharge period, the sustaining discharge is consecutively maintained by superimposing (n+1)th sustaining pulses on the potential difference generated by the positive and negative wall charge accumulated by n-th sustaining discharge. By controlling the number of times for sustaining discharge, the brightness of the display can be controlled for each of the selected display cells. Usually, the sustaining pulses 25 and 26 have repetitive a frequency of approximately 100 KHz at most and each individual pulse has a rectangular waveform.

Since the potentials of the sustaining pulses 25 and 26 are adjusted to a level that does not generate discharge by itself, the wall charge does not exist before the application of the first sustaining pulse 25 in the unselected display cells that did not generate the writing discharge. Therefore, even if the first sustaining pulses 25 are applied, the first sustaining discharge is not generated and no subsequent sustaining discharge is generated in the unselected display cells. In this respect, since the wall charge accumulated by the preliminary discharge is erased by the preliminary discharge erasing pulse 23, no sustaining discharge can be triggered in the unselected display cells.

The conventional AC color PDP as described above, however, has a disadvantage in that the sustaining discharge exhibits a low luminescence efficiency in the PDP, thereby raising the total power dissipation of the PDP.

SUMMARY OF THE INVENTION

An object of the present invention is to solve the above-mentioned problem, and to provide a PDP and a method for driving the same, in which the luminescence efficiency for the sustaining discharge can be improved to thereby reduce the power dissipation of the PDP.

The present invention provides a method for driving a plasma display panel (PDP) having a plurality of display cells arranged in a matrix and each receiving therein discharge gas, first and second sustaining electrodes extending in a first direction of the matrix of display cells, and a data electrode extending in a second direction perpendicular to the first direction, the method comprising the steps of selectively applying a writing pulse between the first sustaining electrode and the data electrode, and applying a sustaining pulse train between the first sustaining electrode and the second sustaining electrode, the sustaining pulse train having a repetitive frequency f defined as follows;

$$f \geqq \mu_i V/(\pi d^2)$$

wherein $\mu_i$, V and d are an ion mobility of the discharge gas, a peak voltage of the sustaining pulse train and a distance between the first sustaining electrode and the second sustaining electrode, respectively.

The present invention also provides a plasma display panel (PDP) device comprising first and second panels, a plurality of display cells sandwiched between the first panel and the second panel in a matrix and each receiving therein discharge gas, first and second sustaining electrodes disposed in a first direction of the matrix of display cells, and a data electrode disposed in a second direction perpendicular to the first direction, the first sustaining electrode being disposed for each row of the matrix of display cells, the second sustaining electrode being disposed for a plurality of rows of the matrix display cells.

In accordance with the present invention, since the PDP exhibits a higher luminescence efficiency in the sustaining discharge, the power dissipation of the PDP can be reduced.

The above and other objects, features and advantages of the present invention will be more apparent from the following description, referring to the accompanying drawings.

DETAILED DESCRIPTION OF THE PREFERRED EMBODIMENT

Before describing embodiments of the present invention, the principle of the PDP of the present invention will be described first. In the description to follow, the scanning electrodes and the common electrodes to which the sustaining pulses are applied are collectively referred to as sustaining electrodes.

Figure 4:
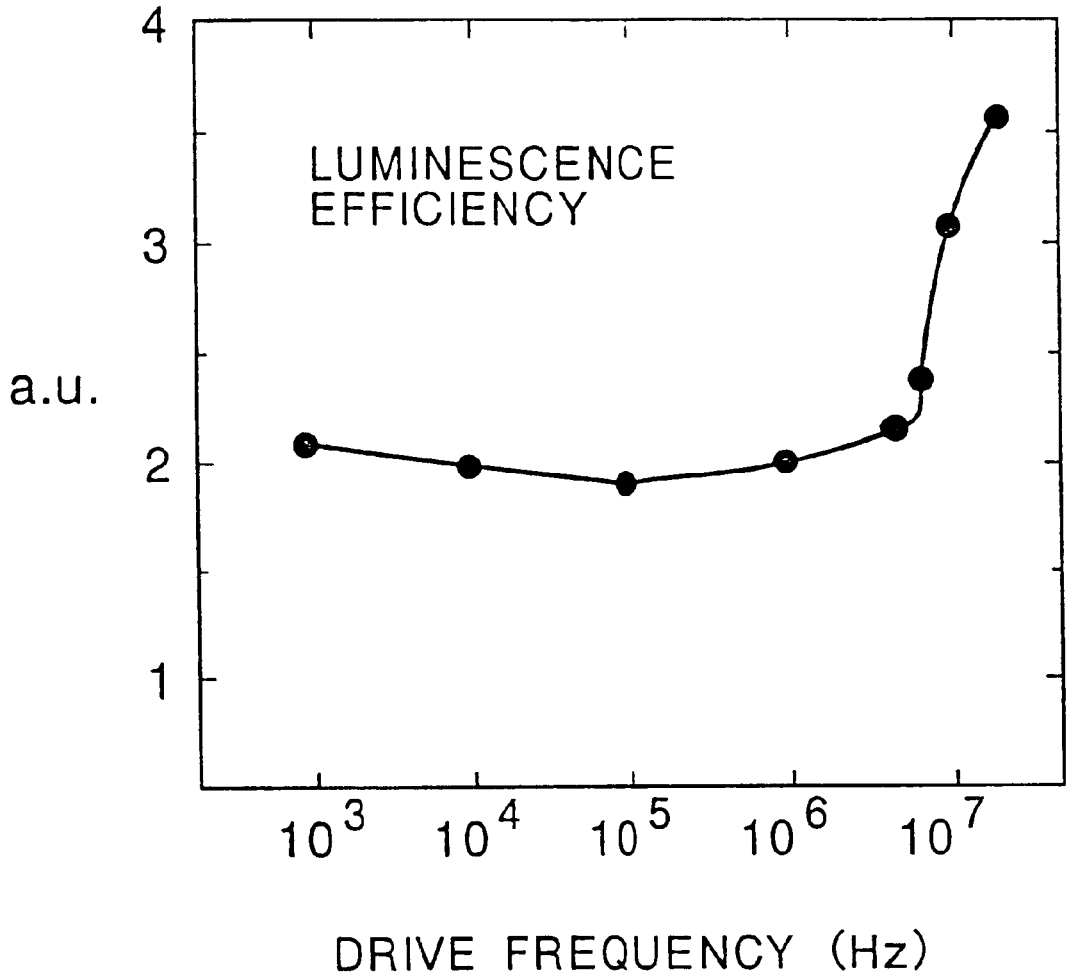
FIG. 4 is a graph showing a relationship between the drive frequency and the luminescence efficiency of a general PDP.

Referring to FIG. 4 showing the relationship between the repetitive frequency of the sustaining pulses (drive frequency) and the luminescence efficiency in an AC color PDP. In FIG. 4, it is noted that the luminescence efficiency increases when the drive frequency exceeds approximately 3 MHz, and remarkably increases when the drive frequency exceeds approximately 10 MHz. Therefore, if the sustaining discharge is effected by the sustaining pulse having a drive frequency exceeding about 3 MHz, preferably about 10 MHz, a high luminescence efficiency can be obtained in the PDP. This increase of the luminescence efficiency is considered originating from the fall of ion temperature in the plasma discharge.

In a paragraph "SPARKING VOLTAGE IN HIGH FREQUENCY DISCHARGE" (pp. 153–155), in a book entitled "BASIC OF GAS DISCHARGE", 1990, by Susumu Takeda, published from Tokyo Denki College Publishing Division, the following description appears. Assuming that $\mu_i$, d, f and $E \cdot \cos(2\pi f \cdot t)$ are ion mobility of the discharge gas, distance between the electrodes, frequency of the electric field, intensity of the electric field at a time instant t, if the frequency f is higher than $2\ \mu_i\ E(2\pi\ d)$, an ion capture phenomenon occurs in which the number of ions that cannot reach the electrodes increases. It is recited that the sparking voltage at which the plasma discharge starts is lowered in this case due to the action by the positive space charge. The electric field frequency f can be expressed by equation, $f=\mu_i V/(\pi\ d^2)$, wherein V is a peak voltage of the applied drive pulse. The distance d between the electrodes is referred to as a discharge length in the discharge space during the sustaining discharge period. In this text, for simplicity, the shortest discharge path is regarded as the distance d. Thus, d is referred to as the shortest distance d between sustaining electrodes in a DC PDP, whereas d is referred to as the shortest distance between imaginary electrodes projected to the surface of the insulator at the discharge space in an AC PDP.

After the ions are captured between the sustaining electrodes, energy that was consumed by ion movement to raise ion temperature becomes unnecessary, whereby the energy to be input from outside the PDP decreases. Thus, the sustaining discharge can be effected by less energy compared to the conventional PDP. In other words, application of the sustaining pulse that has higher frequency than $\mu_i V/(\pi d^2)$ between the sustaining electrodes to decide the brightness of the display is desirable for generating the ion capture phenomenon. For example, when V=200 volts, d=0.01 cm, and $\mu_i$=1 $cm^2/Vs$, the above-mentioned effect can be obtained in the case where the frequency f of the electric field is higher than approximately 2 MHz.

If the ion capture phenomenon is effected by a high frequency drive, the voltage of the sustaining pulse in the PDP can be reduced because the sparking voltage is lowered. The voltage reduction of the sustaining pulse is effective from a practical standpoint because a request for a high withstand voltage for the driving circuit of the PDP can be tempered. In addition, the drive frequency for effecting the ion capture phenomenon largely depends on the composition of the discharge gas and the structure of the display cell of the PDP, and is more than several megahertz (MHz) if the usual discharge gas and cell structure are used. Such a high frequency hardly enables application of the conventional rectangular pulse to the drive circuit of the PDP, which assumes a capacitive load. Therefore, it is desirable to use a sinusoidal wave pulse.

Figure 5:
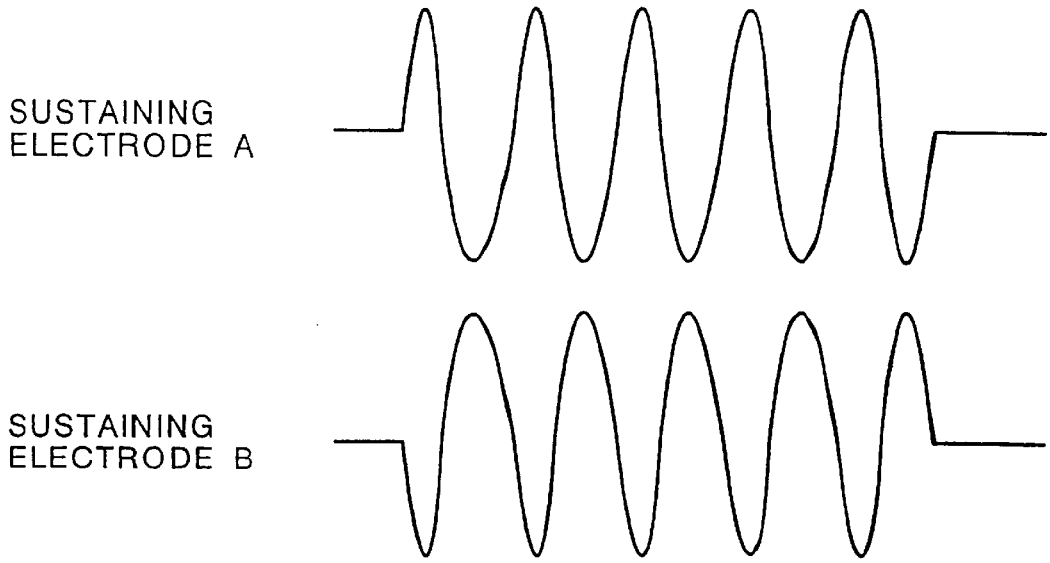
FIG. 5 is an example of drive voltage waveforms of the sustaining pulses in a PDP according to a principle of the present invention.

Referring to FIG. 5, the illustrated timing chart includes the voltage waveform for the sustaining electrode A (common electrode, for example) and the voltage waveform for the sustaining electrode B (scanning electrode, for example). The sustaining electrode A and the sustaining electrode B form a pair for sustaining discharge, and the sinusoidal waves applied to the sustaining electrodes A and B are opposite in phase to each other. The voltage applied to each display cell of the PDP is represented by the difference between the waveforms applied to the sustaining electrodes A and B. Therefore, the sinusoidal wave voltages of FIG. 5 can reduce the amplitudes of the drive pulses applied to the respective sustaining electrodes A and B.

Figure 6:
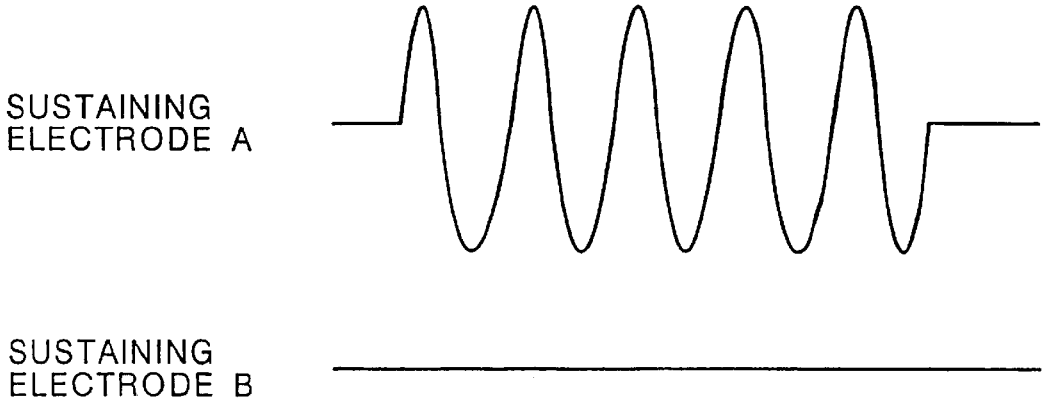
FIG. 6 shows another example of drive voltage waveforms of the sustaining pulses in a PDP according to a principle of the present invention.

Referring to FIG. 6, the illustrated timing chart includes the sinusoidal wave voltage for the sustaining electrode A and a constant voltage for the sustaining electrode B. In this case, although the amplitude of the applied sinusoidal wave is larger compared to the case of FIG. 5, the drive circuit can be simplified due to the constant voltage for the sustaining electrode B. Both the drive voltages shown in FIGS. 5 and 6 are effective to application of a higher frequency voltage for obtaining the ion capture phenomenon due to the sinusoidal wave voltages.

Now, PDPs according to embodiments of the present invention are specifically described with reference to accompanying drawings, wherein similar constituent elements are designated by similar reference numerals throughout the drawings.

Figure 1:
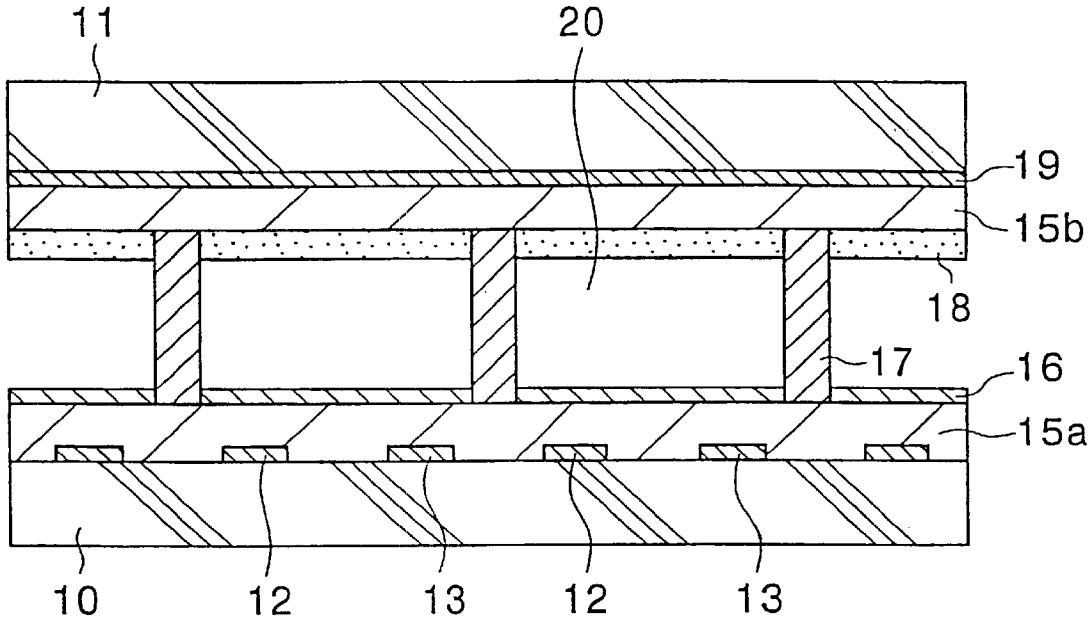
FIG. 1 PRIOR ART
FIG. 1 is a cross-sectional view of a conventional AC color PDP.
Figure 2:
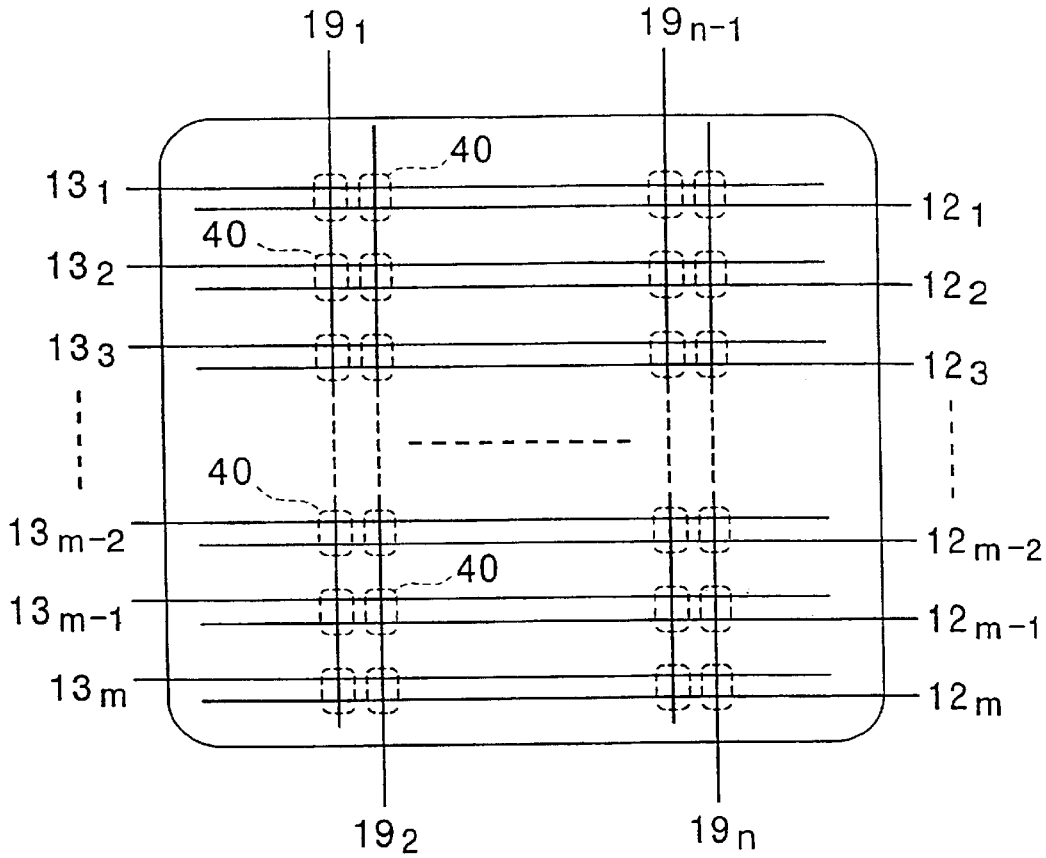
FIG. 2 PRIOR ART
FIG. 2 is a schematic block diagram of the PDP of FIG. 1.
Figure 3:
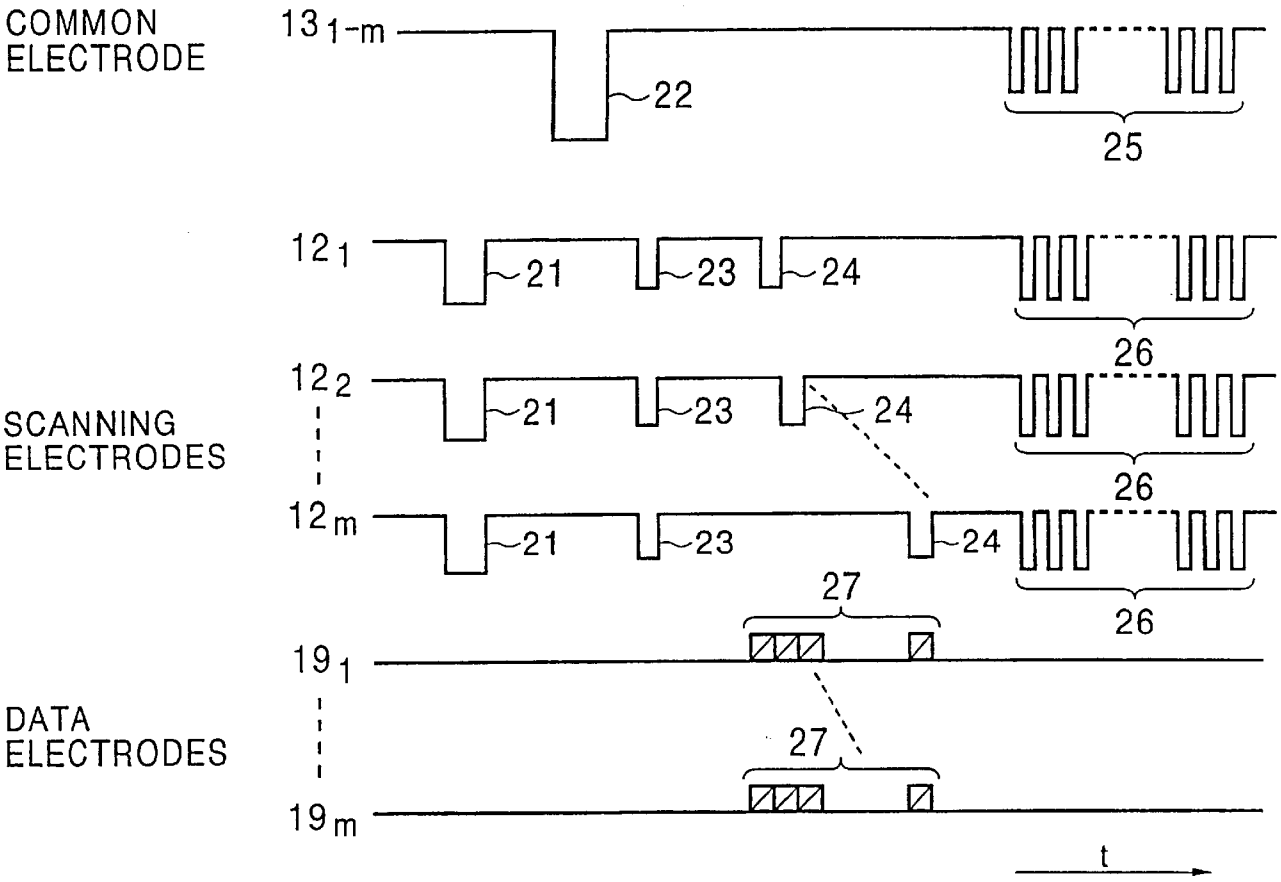
FIG. 3 PRIOR ART
FIG. 3 is a timing chart of the drive voltage waveforms applied to the electrodes of the PDP of FIG. 1.
Figure 7:
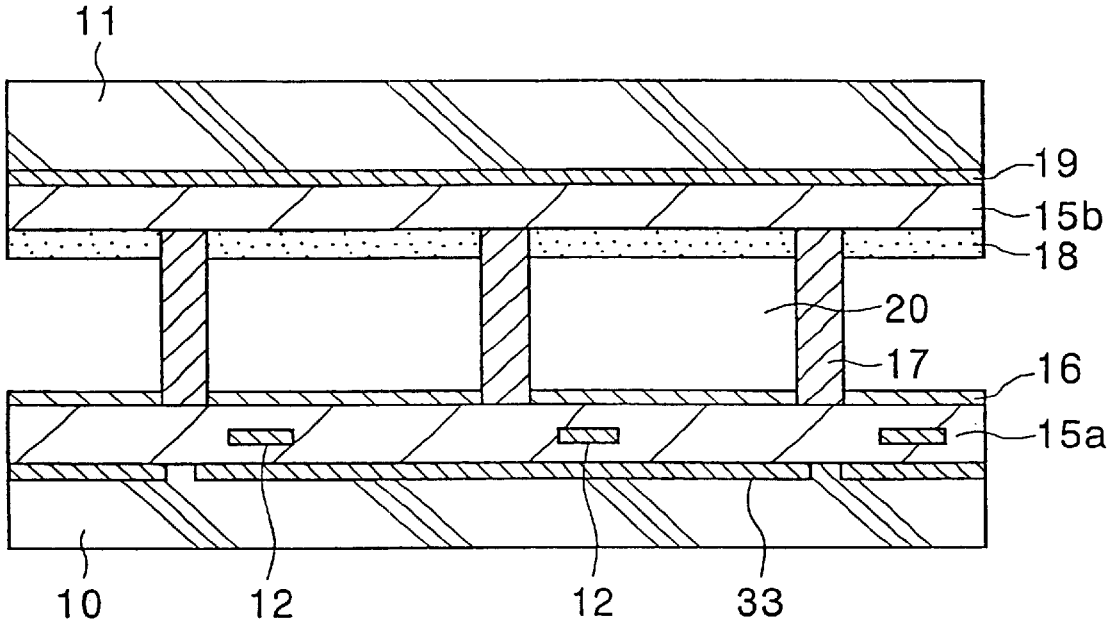
FIG. 7 is a cross-sectional view of an AC color PDP according to a first embodiment of the present invention.
Figure 8:
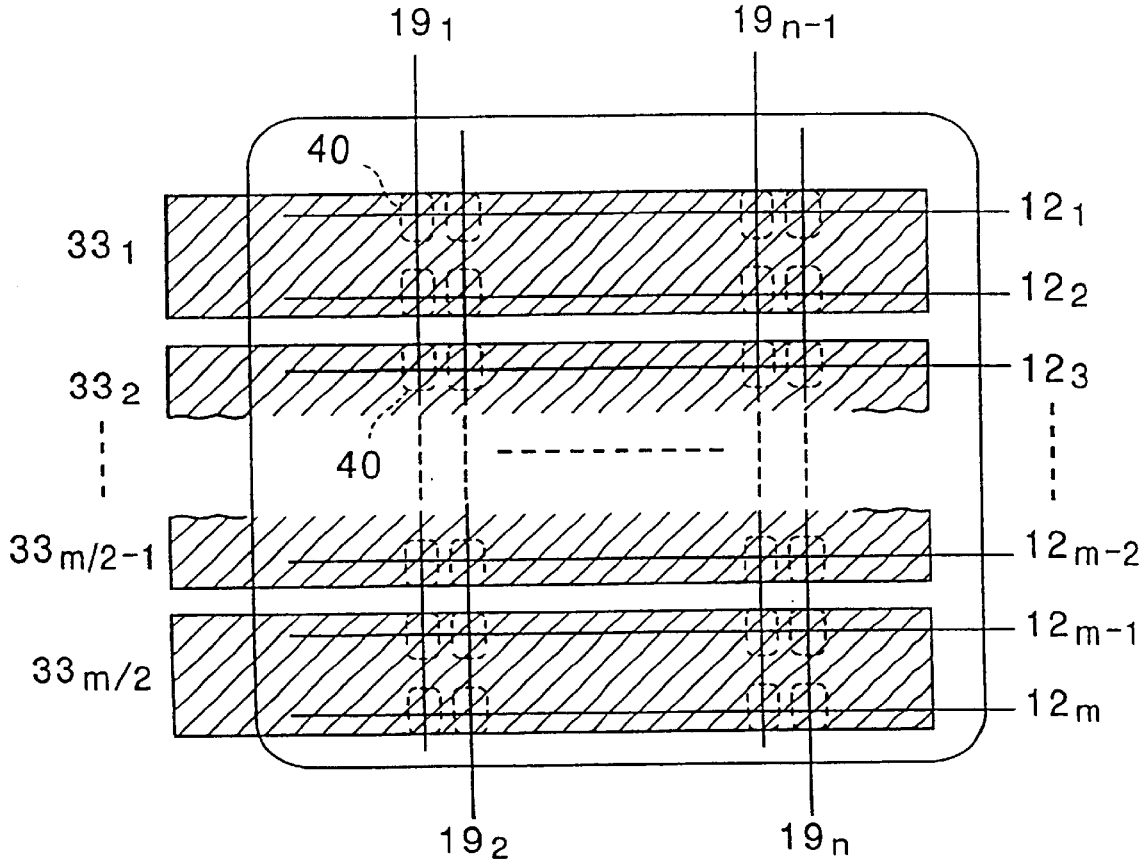
FIG. 8 is a schematic block diagram of the PDP of FIG. 7.

Referring to FIGS. 7 and 8 showing, similarly to FIGS. 1 and 2, respectively, an AC color PDP according to a first embodiment of the present invention, the PDP includes front and rear substrates 10 and 11 made of glass. On the front substrate 10, a plurality of common electrodes 33 are formed, each of which has a relatively large width and extend in the direction normal to the sheet of FIG. 4. An insulator layer 15*a* is formed covering the common electrodes 33 on the front substrate 10. In the insulator layer 15*a*, there are disposed a plurality of scanning electrodes 12 each having a smaller width than the common electrodes 33. The scanning electrodes 12 extend in parallel to one another and to the common electrodes 33, with a space disposed between the scanning electrode 12 and a corresponding common electrode 33. A protective layer 16 is formed on the insulator layer 15*a* for protection of the insulator film 15*a* against the plasma discharge. On the rear substrate 11, data electrodes 19 are formed which extend perpendicularly to the scanning electrodes 12 and common electrodes 33. An insulator layer 15*b* is formed on the rear substrate 11 for covering the data electrodes 19. In addition, a fluorescent film 18 for converting the ultraviolet ray generated by the discharge into visual light is formed on the insulator layer 15*b* by coating.

A discharge space 20 is formed between the front substrate 10 and the rear substrate 11, and discharge gas containing a mixture of He, Ne, Ar, Kr, Xe, $N_2$, $O_2$, $CO_2$ and other gases is filled in the discharge space 20. The discharge space 20 is secured by a lattice partition 17, which separates the front substrate 10 from the rear substrate 11, and divides the discharge space 20 into a plurality of display cells. The fluorescent film 18 is colored in red, green or blue in each display cell, so as to display a multi-color image.

As shown in FIG. 8, the electrode arrangement of the PDP includes pairs of scanning electrodes $\mathbf{12}_1$–$\mathbf{12}_m$ and common electrodes $\mathbf{33}_1$–$\mathbf{33}_{m/2}$, as well as data electrodes $\mathbf{19}_1$–$\mathbf{19}_n$. The scanning electrodes $\mathbf{12}_1$–$\mathbf{12}_m$ and common electrodes $\mathbf{33}_1$–$\mathbf{33}_{m/2}$ constitute row electrode which extend in the row direction parallel to one another on the front substrate 10. The data electrodes $\mathbf{19}_1$–$\mathbf{19}_n$ constitute column electrodes which extend in the column direction parallel to one another on the rear substrate 11. Display cells 40 are disposed at cross points of the row electrodes and the column electrodes. In FIG. 8, display cells 40 are indicated by blocks arranged in a matrix with m rows and n columns.

In the PDP of the present embodiment, the scanning electrodes 12 and common electrodes 33 are disposed in different layers separated by the insulator layer 15*a*. As previously discussed, a single driving period of the PDP includes a preliminary discharge period, a writing discharge period, and a sustaining discharge period. The sustaining discharge is effected between the common electrode 33 and the data electrode 19, which are referred to as the sustaining electrodes in this text, and the preliminary discharge pulse is applied between the first sustaining electrode (12) and the second sustaining electrode (33) before a writing pulse is applied.

As described above with reference to FIG. 1, the conventional PDP has an electrode arrangement in which a pair of independent sustaining electrodes are disposed for each row of display cells, and two groups of the row electrodes including the scanning electrodes 12 and the common electrodes 13 are disposed alternately on the same plane. On the contrary to the conventional electrode arrangement, the present embodiment has an electrode arrangement in which the common electrodes have a large width in the column direction. Specifically, each of the common electrodes $\mathbf{33}_1$–$\mathbf{33}_{m/2}$ has a width corresponding to a pair of columns of the display cells 40. Thus, each of the common electrodes $\mathbf{33}_1$–$\mathbf{33}_{m/2}$ form a pair with a scanning electrode 12 and another pair with an adjacent scanning electrode 12. This affords an effect in that the electric capacitance between adjacent common electrodes is reduced. As a result, the reactance component (i.e., capacitive and inductive components) of the input impedance is reduced in the present embodiment. Accordingly, the luminescence efficiency in the sustaining discharge can be increased while reducing the power dissipation.

Figure 9:
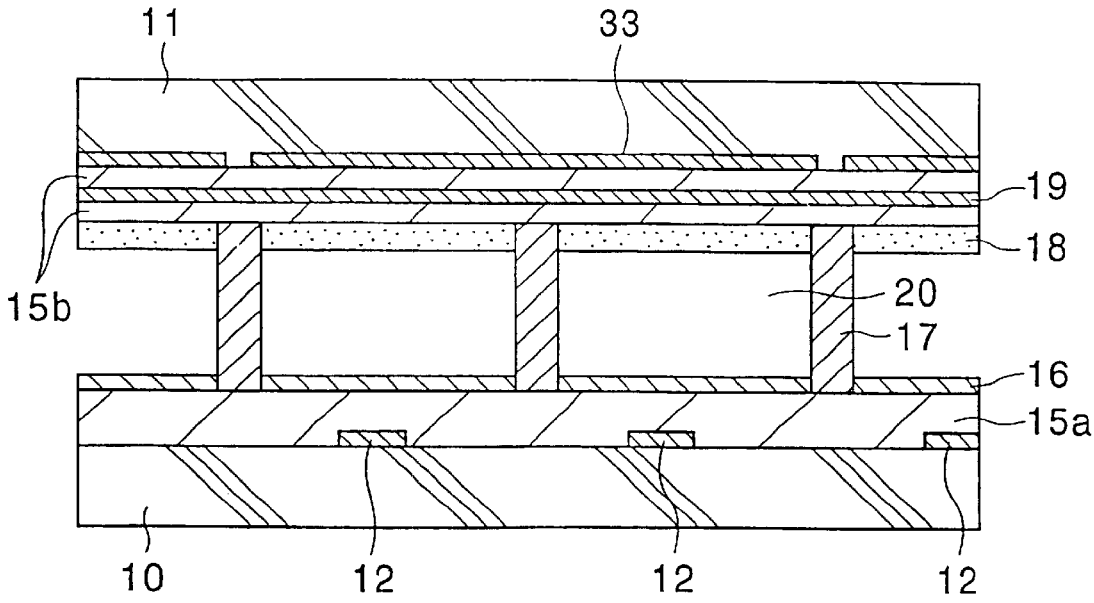
FIG. 9 is a cross-sectional view of an AC color PDP according to a second embodiment of the present invention.

Referring to FIG. 9, a second embodiment of the present invention is similar to the first embodiment except that the common electrodes 33 having a large width are formed on the rear substrate 11 in the present embodiment.

Specifically, the scanning electrodes 12 extend in the row direction (normal to the sheet of FIG. 9) on the front substrate 10 with a predetermined space therebetween. The scanning electrodes 12 are covered with an insulator layer 15*a*, on which a protective layer 16 is formed. On the rear substrate 11, the common electrodes 33 are formed in parallel with the scanning electrodes 12 similarly to the first embodiment. Each of the a plurality of (m/2) common electrodes 33 forms a pair with a scanning electrode 12 and another pair with an adjacent scanning electrode. An insulator layer 15*b* is formed on the surface of the common electrode 33. In the insulator layer 15*b*, n data electrodes 19 are formed extending perpendicularly to the common electrodes 33. The common electrodes 33 are separated and insulated form the data electrodes 19 by the insulator layer 15*b*. On the insulator layer 15*b*, a fluorescent film 18 is formed by coating.

In the PDP of the present embodiment, the sustaining discharge is effected between the scanning electrode 12 and the common electrode 33 to achieve the advantages, similarly to the first embodiment. In addition, the common electrode are formed on the rear substrate, which affords an advantage in that transmittance in the front substrate 10 can be increased, which achieve an additional advantage of a higher brightness.

Figure 10:
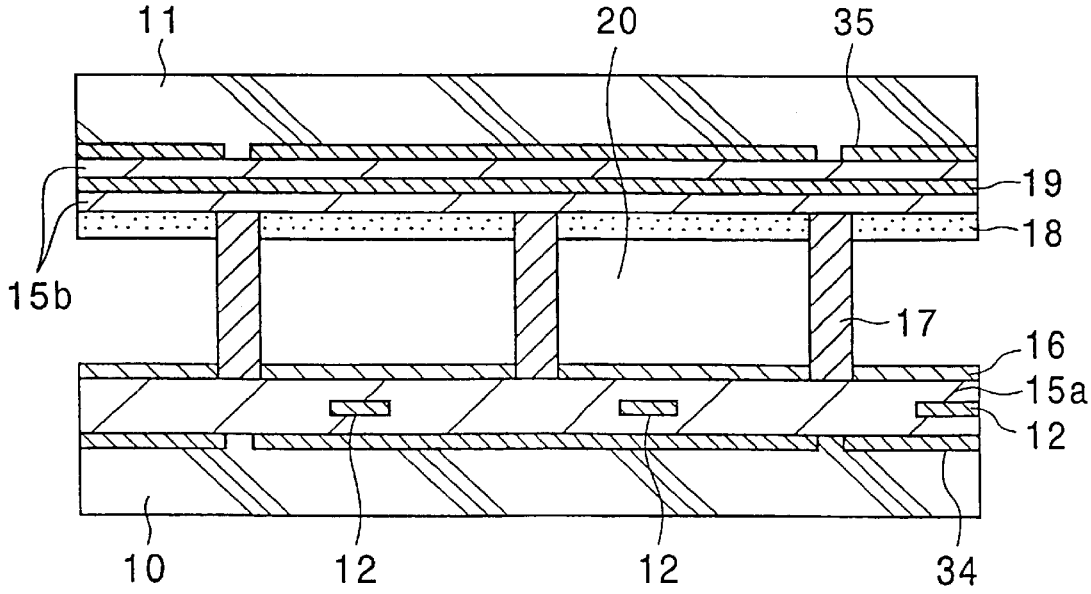
FIG. 10 is a cross-sectional view of an AC color PDP according to a third embodiment of the present invention.

Referring to FIG. 10, a PDP according to a third embodiment of the present invention is similar to the first embodiment except that both the front substrate 10 and the rear substrate 11 have the sustaining electrodes. Specifically, first sustaining electrodes 34 are formed on the front substrate 10 in parallel with the scanning electrodes 12 in the row direction. The first sustaining electrodes correspond to the common electrodes 33 in the first embodiment. Second sustaining electrodes 35 having the same width as the first sustaining electrodes 34 are formed on the rear substrate 11 in parallel with the scanning electrodes 12 in the row direction.

The first sustaining electrodes 34 are covered by the insulator layer 15*a*. In the insulator layer 15*a*, a plurality of scanning electrodes 12 are formed in the row direction with a predetermined pitch. Each of the scanning electrodes 12 is disposed at a predetermined distance from a corresponding first sustaining electrode 34. On the insulator layer 15*a*, a protective layer 16 is formed. Another protective layer 15*b* is formed on the second sustaining electrodes 35 on the rear substrate 11. Data electrodes 19 are formed in the protective layer 15*b*, extending perpendicularly to the second sustaining electrodes 35. On the insulator layer 15*b*, a fluorescent film 18 is formed by coating. In addition, a discharge space 20 is formed similarly to the first or second embodiment.

In the PDP of the present embodiment, the sustaining discharge is effected between the first sustaining electrodes 34 and the second sustaining electrodes 35 to achieve an advantage similarly to the first embodiment. In the present embodiment, the scanning electrodes 12 extending in the row direction and the data electrodes 19 extending in the column direction are provided for addressing of the display cells independently of the first and second sustaining electrodes 34 and 35. Accordingly, four kinds of electrodes are provided for a single display cell. The input impedance of the first and second sustaining electrodes 34 and 35 to which the sustaining pulse is applied is made small similarly to the common electrodes 33 in the first or second embodiment. As a result, a high frequency driving voltage can be applied efficiently.

In each embodiment described above, each of the common electrodes 33 as well as the first sustaining electrodes 34 or the second sustaining electrodes 35 form a pair with a scanning electrode and another pair with an adjacent scanning electrodes 12. However, the number of rows formed as the pairs by a single common electrode is not limited to these arrangements, but any number up to the whole line number in the display area can be selected. In addition, the row direction and the column direction can be exchanged.

Since the above embodiments are described only for examples, the present invention is not limited to the above embodiments and various modifications or alterations can be easily made therefrom by those skilled in the art without departing from the scope of the present invention.

What is claimed is:

1. A method for driving a plasma display panel (PDP) having a plurality of display cells arranged in a matrix and each receiving therein discharge gas, first and second sustaining electrodes extending in a first direction of said matrix of display cells, and a data electrode extending in a second direction perpendicular to said first direction, said method comprising the steps of selectively applying a writing pulse between said first sustaining electrode and said data electrode, and applying a sustaining pulse train between said first sustaining electrode and said second sustaining electrode, said sustaining pulse train having a repetitive frequency f defined as follows;

$$f \geqq \mu_i V/(\pi d^2)$$

wherein $\mu_i$, V and d are an ion mobility of said discharge gas, a peak voltage of said sustaining pulse train and a distance between said first sustaining electrode and said second sustaining electrode, respectively.

2. The method as defined in claim 1, wherein said repetitive frequency f is larger than 3 MHz.

3. The method as defined in claim 1, wherein said sustaining pulse train has a sinusoidal waveform.

4. The method as defined in claim 3, wherein said sustaining pulse train applying step includes applying said sustaining pulse train to said first sustaining electrode while maintaining said second sustaining electrode at a constant voltage.

5. The method as defined in claim 3, wherein said sustaining pulse train applying step includes applying first and second sinusoidal voltages to said first and second sustaining electrodes (12, 13), respectively.

6. The method as defined in claim 1, further comprising the step of applying a preliminary discharge pulse between said first sustaining electrode and said second sustaining electrode before writing pulse applying step.

* * * * *

UNITED STATES PATENT AND TRADEMARK OFFICE

CERTIFICATE OF CORRECTION

PATENT NO. : 6,356,017 B1
DATED : March 12, 2002
INVENTOR(S) : Mitsuyoshi Ma

It is certified that error appears in the above-identified patent and that said Letters Patent is hereby corrected as shown below:

Title page,
Item [30], Foreign Application Priority Data, delete "September 1, 1998" insert -- January 9, 1998 --

Column 4,
Line 55, delete "ion mobility", insert -- ion mobility $\mu$i --
Line 58, delete "E (2 $\pi$ d)" insert -- E/(2 $\pi$ d) --

Signed and Sealed this

Twenty-eighth Day of September, 2004

JON W. DUDAS
*Director of the United States Patent and Trademark Office*